US007455625B2

(12) United States Patent
Stearns et al.

(10) Patent No.: US 7,455,625 B2
(45) Date of Patent: Nov. 25, 2008

(54) ELLIPTICAL EXERCISE METHODS AND APPARATUS

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 11/800,431

(22) Filed: May 4, 2007

(65) Prior Publication Data

US 2007/0265143 A1 Nov. 15, 2007

Related U.S. Application Data

(60) Provisional application No. 60/799,419, filed on May 9, 2006.

(51) Int. Cl.
*A63B 22/04* (2006.01)
*A63B 69/16* (2006.01)

(52) U.S. Cl. ..... 482/52; 482/57

(58) Field of Classification Search ..... 482/51, 482/52, 57, 70, 79–80
See application file for complete search history.

(56) References Cited

U.S. PATENT DOCUMENTS

| | | | | |
|---|---|---|---|---|
| 5,573,480 | A | 11/1996 | Rodgers, Jr. | 482/57 |
| 5,653,662 | A | 8/1997 | Rodgers, Jr. | 482/52 |
| 5,762,588 | A | 6/1998 | Chen | 482/57 |
| 5,800,315 | A | 9/1998 | Yu et al. | 482/57 |
| 5,993,359 | A | 11/1999 | Eschenbach | 482/57 |
| 6,135,923 | A | 10/2000 | Stearns et al. | 482/51 |
| 6,196,948 | B1 | 3/2001 | Stearns et al. | 482/52 |
| 6,248,044 | B1 | 6/2001 | Stearns et al. | 482/52 |
| 6,450,925 | B1 * | 9/2002 | Kuo | 482/52 |
| 6,629,909 | B1 | 10/2003 | Stearns et al. | 482/52 |
| 6,672,992 | B1 * | 1/2004 | Lo et al. | 482/52 |
| 6,835,166 | B1 | 12/2004 | Stearns et al. | 482/52 |
| 7,041,036 | B1 * | 5/2006 | Kuo | 482/52 |
| 7,060,004 | B2 * | 6/2006 | Kuo | 482/52 |

* cited by examiner

*Primary Examiner*—Stephen R. Crow

(57) ABSTRACT

An exercise apparatus links rotation of left and right crank members to elliptical movement of left and right foot supporting members. Rollers on the cranks allow the foot supporting members to translate relative to the cranks, and crank driven linkage arrangements determine the extent of the translation.

7 Claims, 5 Drawing Sheets

ELLIPTICAL EXERCISE METHODS AND APPARATUS

CROSS-REFERENCE TO RELATED APPLICATION

Disclosed herein is subject matter that is entitled to the filing date of U.S. Provisional Application No. 60/799,419, filed May 9, 2006.

FIELD OF THE INVENTION

The present invention relates to exercise methods and apparatus and more particularly, to exercise equipment that guides a person's feet through generally elliptical paths of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and various other machines allow a person to skate and/or stride in place. Yet another type of machine has been designed to facilitate relatively more complicated exercise motion and/or to better simulate real life activity. Such equipment typically converts a relatively simple motion, such as circular, into a relatively more complex motion, such as elliptical. Examples of such equipment are disclosed in U.S. Pat. No. 4,185,622 to Swenson; U.S. Pat. No. 5,383,829 to Miller; U.S. Pat. No. 5,540,637 to Rodgers, Jr.; U.S. Pat. No. 5,882,281 to Stearns et al.; and U.S. Pat. No. 5,993,359 to Eschenbach. Despite many advances in elliptical motion exercise machines, room for improvement still exists.

SUMMARY OF THE INVENTION

The present invention may be described in terms of linkage assemblies and corresponding exercise apparatus which link circular motion to relatively more complex, generally elliptical motion. On a preferred embodiment, left and right crank members are rotatably mounted on a frame at diametrically opposed locations relative to a common crank axis, and left and right linkages are movably interconnected between the frame and respective crank members. The linkages include foot supporting links that are supported on, but not coupled to, respective crank members for purposes of determining vertical movement or stride height of a person's feet (as a function of the crank diameter defined by the crank members). The linkages also include crank amplifying arrangements that determine horizontal movement or stride length of the person's feet (independent of the crank diameter). Each crank amplifying arrangement includes a crank link movably interconnected between a respective crank member and at least one guide on the frame; an intermediate link having a lower end rotatably connected to a respective crank link, proximate the at least one guide; and a rocker link having an upper portion rotatably mounted on the frame, an offset arm rotatably connected to the upper end of a respective intermediate link. A lower portion of each rocker link is rotatably connected to a forward end of a respective foot supporting link, and an opposite, rearward end of each foot supporting link defines a foot platform.

On the preferred embodiment, the left and right crank members are rotatably mounted on respective sides of the frame in a manner that defines a space therebetween, and the foot platforms are preferably configured and arranged to accommodate movement of a person's feet into the space defined between the crank members. This arrangement allows for shorter machines without sacrificing stride length. If desired, at least one guard or shield may be provided between the foot platforms to eliminate pinch points and/or reduce the likelihood of the user's feet or ankles striking one another during exercise.

In another respect, the present invention may be described in terms of linkage assemblies and corresponding exercise apparatus which link reciprocal motion to relatively more complex, generally elliptical motion. For example, left and right handlebar links may be pivotally mounted on the frame and linked to at least one link in the elliptical motion linkage assembly. On the preferred embodiment, left and right handles are mounted on upper distal ends of respective rocker links. As the foot supports move through their generally elliptical paths, the handles pivot back and forth relative to the frame. In order to accommodate the proximity of the foot platforms on the preferred embodiment, the frame may be provided with opposite side posts for supporting respective handlebar links at outboard locations relative to the foot supporting linkages.

In yet another respect, the present invention may be described in terms of linkage assemblies and corresponding exercise apparatus which independently generate the horizontal and vertical components of generally elliptical exercise motion. In this regard, the foot platforms are driven up and down by respective crank members (as a function of the crank diameter), and forward and backward by respective crank amplifying arrangements (independent of the crank diameter). The fore and aft movement may be varied through a range between a fraction of the crank diameter and several times the crank diameter, either as a matter of design choice or via an adjustment feature incorporated into the machine. Additional features and/or advantages of the present invention may become apparent from the more detailed description that follows.

BRIEF DESCRIPTION OF THE DRAWING

With reference to the Figures of the Drawing, wherein like numerals represent like parts throughout the several views.

DETAILED DESCRIPTION OF THE PREFERRED EMBODIMENT

Figure 1:
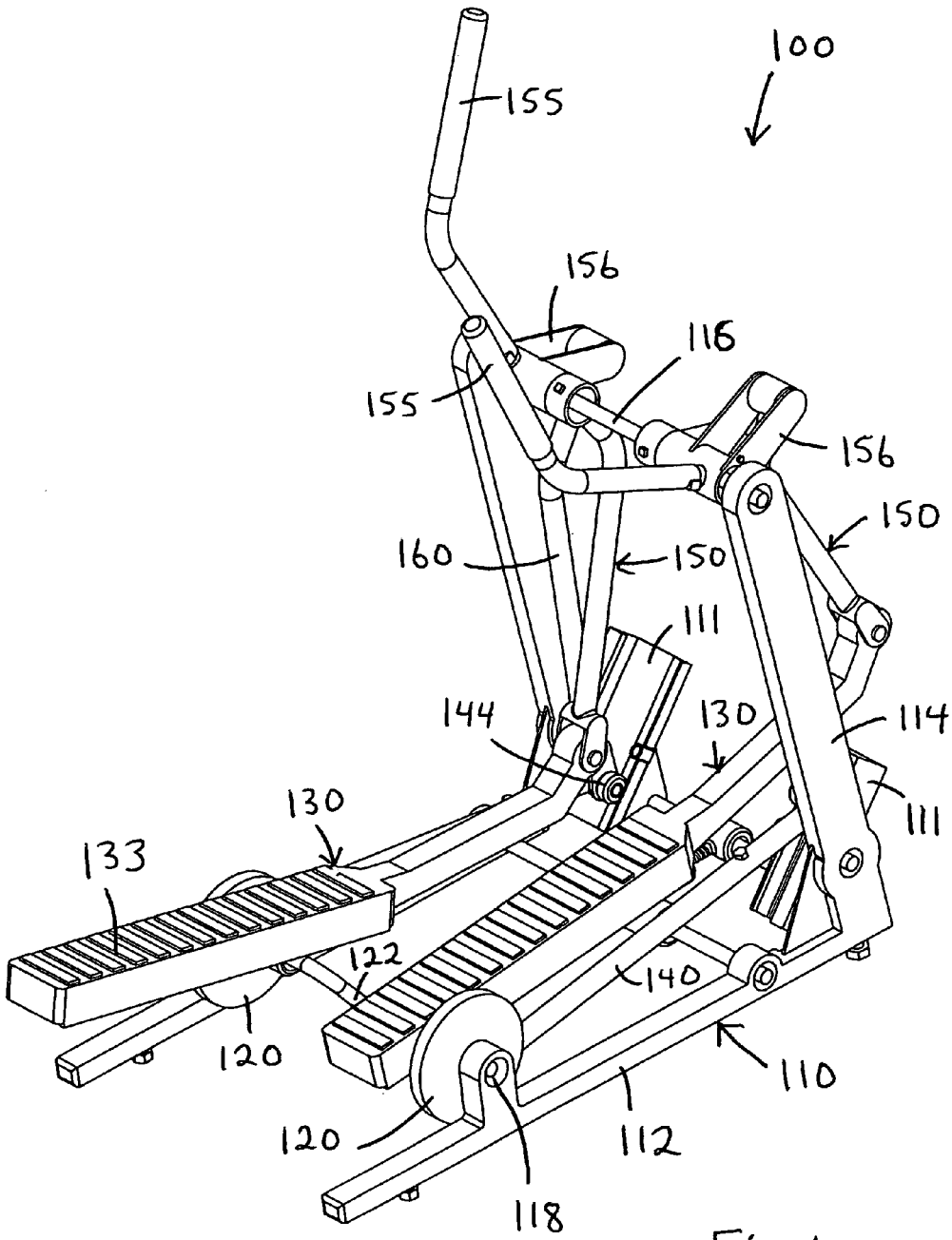
FIG. 1 is a perspective view of a preferred embodiment exercise apparatus constructed according to the principles of the present invention.

The present invention provides elliptical motion exercise machines which link rotation of left and right crank members to generally elliptical motion of respective left and right foot supports. The term "elliptical motion" is intended in a broad sense to describe a closed path of motion having a relatively longer major axis and a relatively shorter minor axis. In general, the present invention may be said to use displacement of the crank members to move the foot supports in a direction coincidental with one axis of the elliptical path, and displacement of crank driven members to move the foot supports in a direction coincidental with the other axis. A general characteristic of the present invention is that the crank diameter determines the length of the one axis, but does not determine the length of the other axis. Also, the crank members are preferably configured and arranged to accommodate a person's feet within a space defined therebetween, while nonetheless traveling through generally elliptical paths having a desirable aspect ratio. As a result, the machines that embody this technology may be made relatively more compact, as well.

The preferred embodiment shown and described herein is generally symmetrical about a vertical plane extending lengthwise through a floor-engaging base (perpendicular to the transverse ends thereof). However, the components of the "right-hand" linkage assembly are generally one hundred and eighty degrees out of phase relative to the components of the "left-hand" linkage assembly. In any event, like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

With the foregoing in mind, the present invention will now be described with reference to a preferred embodiment exercise apparatus designated as 100 in FIGS. 1-5. The machine 100 includes a frame 110 that is designed to rest upon a floor surface and to support left and right linkage assemblies. The frame 110 includes a floor engaging base 112 and a forward stanchion 114 that extends upward from a forward end of the base 112. A user interface and/or display device (not shown) may be mounted on the forward stanchion 114 (on the exposed portion of bar 116, for example) to perform various functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the path of the exercise motion, and/or (f) immediately stop the exercise motion.

Figure 2:
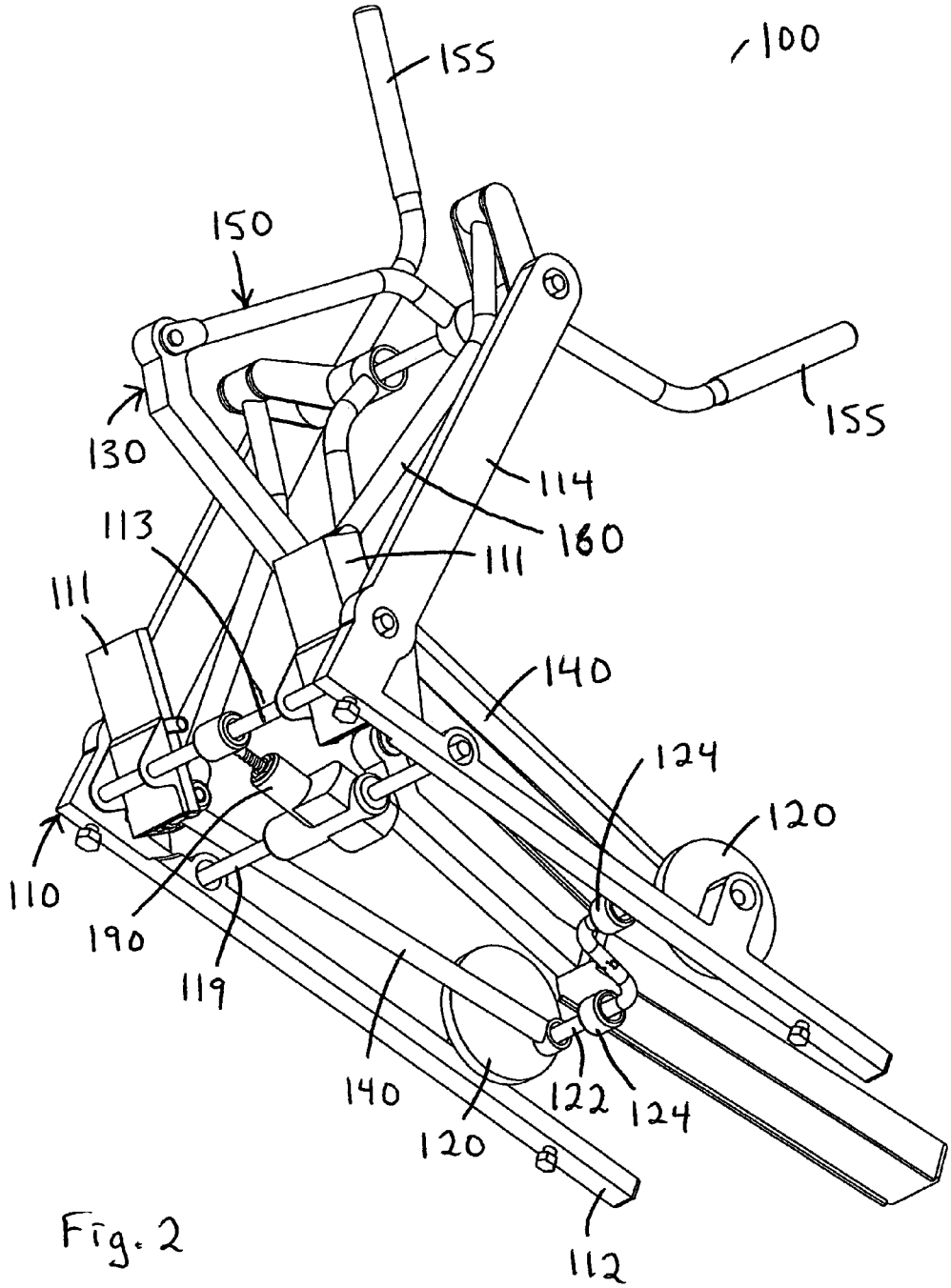
FIG. 2 is a different perspective view of the exercise apparatus of FIG. 1.
Figure 3:
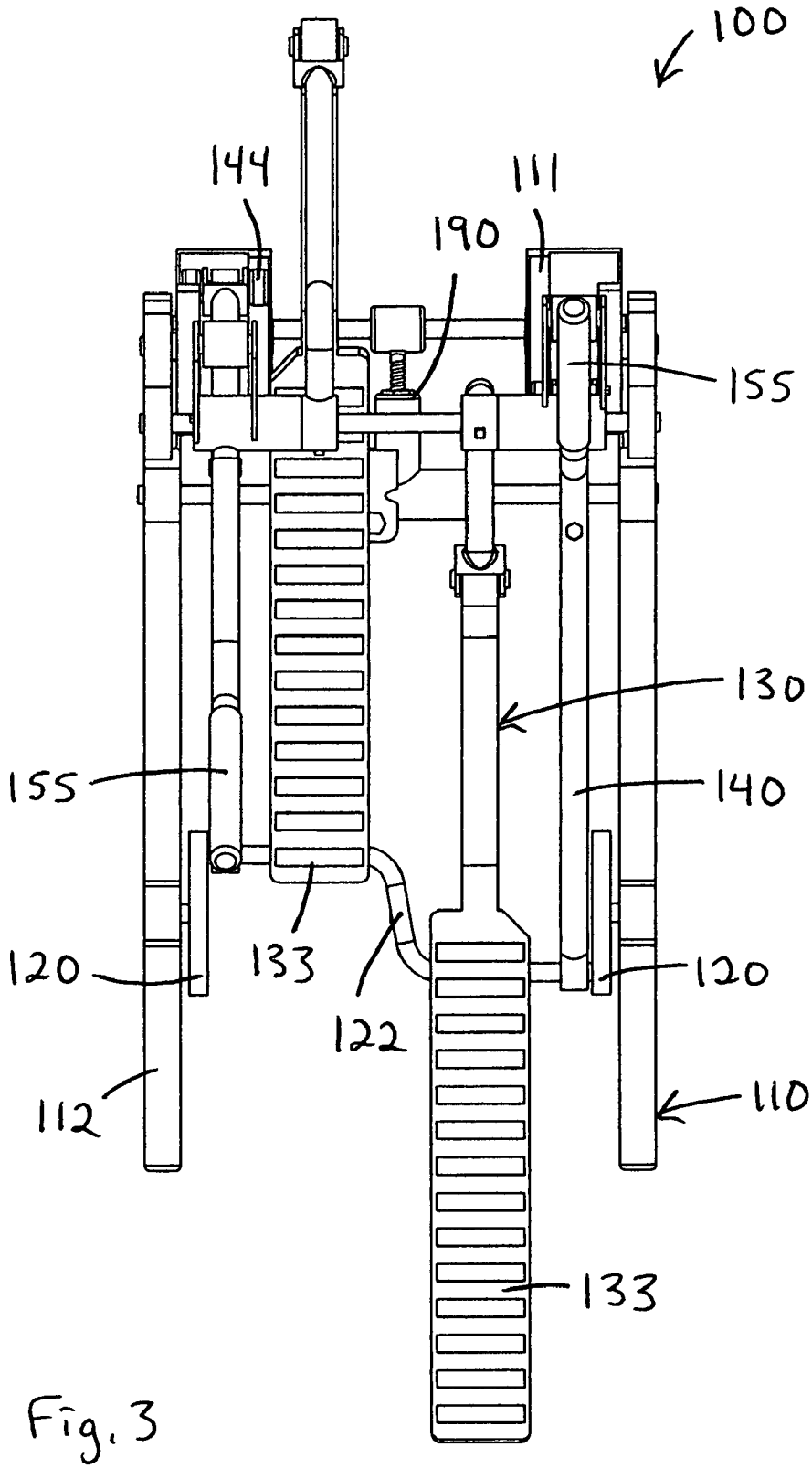
FIG. 3 is a top view of the exercise apparatus of FIG. 1.
Figure 4:
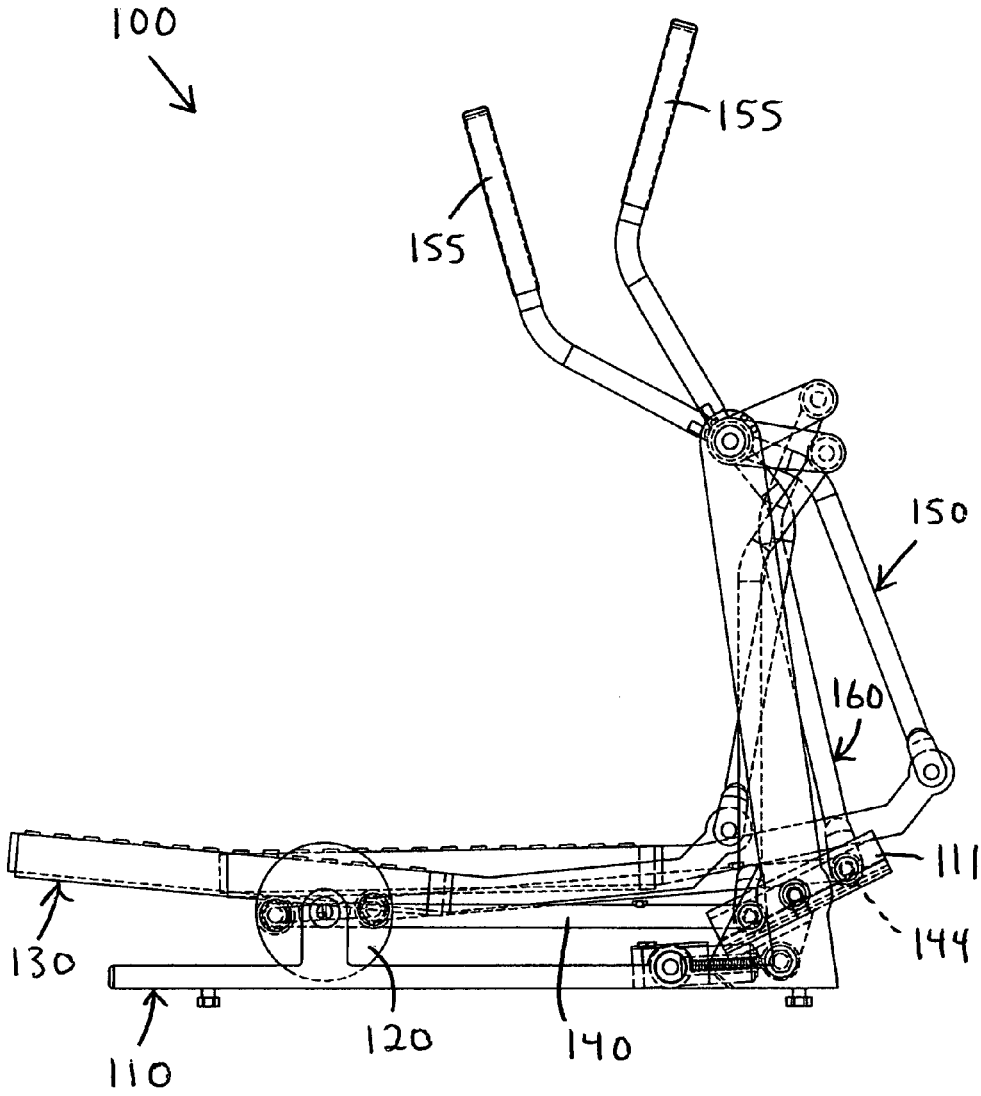
FIG. 4 is a side view of the exercise apparatus of FIG. 1, with the apparatus configured for a relatively short stride length.
Figure 5:
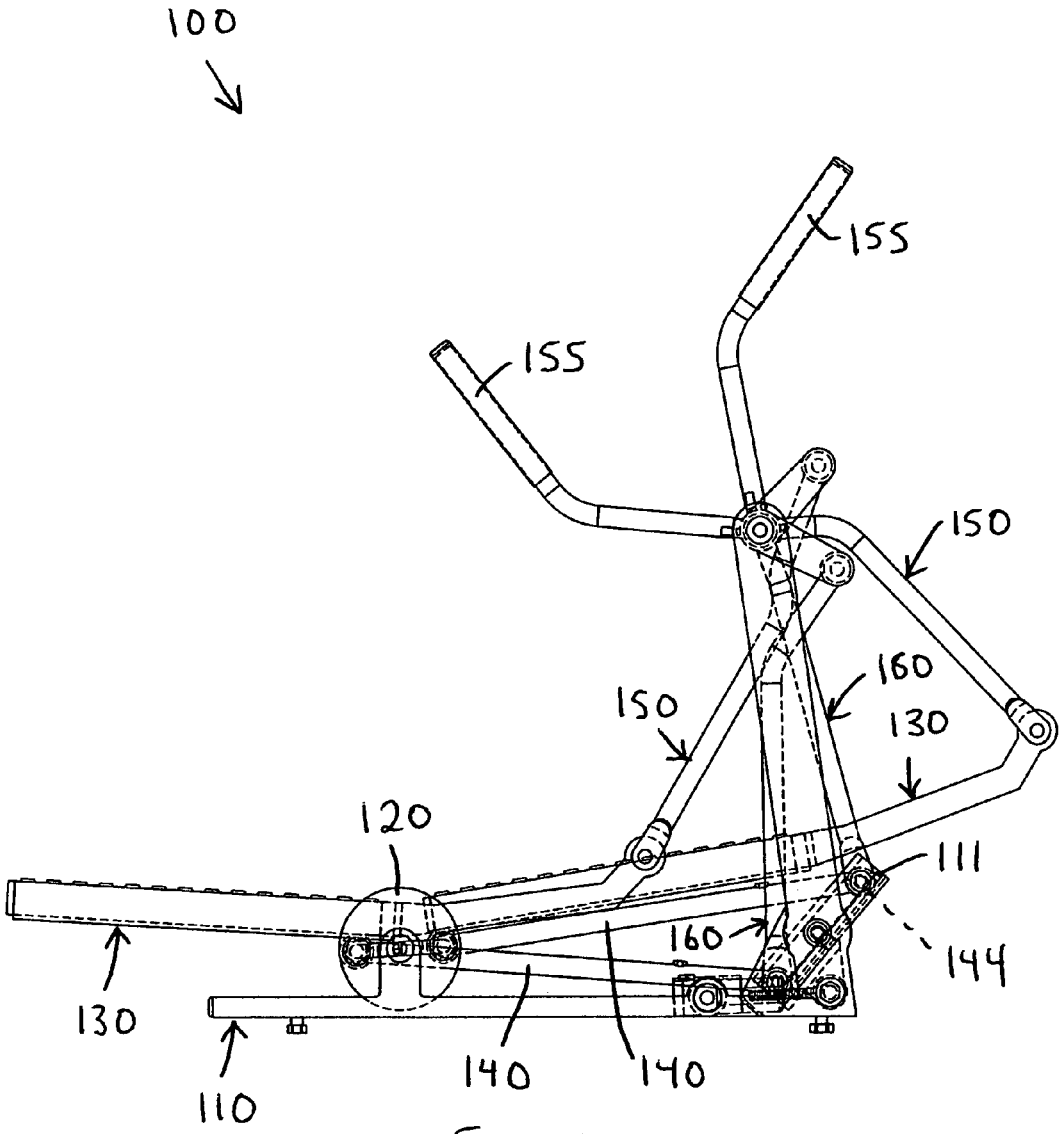
FIG. 5 is a side view of the exercise apparatus of FIG. 1, with the apparatus configured for a relatively long stride length.

Left and right crank discs 120 are rotatably mounted on respective sides of the frame 110 at respective journals 118. An intermediate Z-shaped bar or crank connector 122 is interconnected between the crank discs 120, and constrains the crank discs 120 to rotate together as a unit about a common crank axis. As shown in FIG. 2, left and right crank rollers 124 are rotatably mounted on respective ends of the bar 122, or respective crank members, for rotation relative thereto, and for orbital movement about the crank axis. Each roller 124 is configured and arranged to underlie a rearward portion of a respective foot supporting link 130, as further described below. Also, left and right crank links 140 have rearward ends that are also rotatably mounted on respective ends of the bar 122, or respective crank members, for rotation relative thereto, and for orbital movement about the crank axis. Left and right guide rollers 144 are rotatably mounted on opposite, forward ends of the crank links 140 for reasons described below.

At least one of the crank discs 120 is preferably connected to a conventional inertia altering device (not shown), including, for example, a motor, a "stepped up" flywheel, an adjustable braking mechanism, or some combination thereof. For example, a belt is preferably looped about the cylindrical wall of one disc 120 and also about a relatively smaller diameter pulley spaced radially apart from the rotational axis of the disc 120. The pulley is constrained to rotate together with a relatively larger diameter flywheel, subject to resistance imparted on the flywheel by a conventional eddy current brake. Persons skilled in the art will also recognize that at least one of the crank discs 120 may be replaced by a crank arm on an alternative embodiment.

Left and right rocker links 150 are rotatably mounted on respective sides of the forward stanchion 114 for pivoting about a common pivot axis. More specifically, each rocker link 150 includes a base member or tube that is mounted coaxially on a respective portion of the bar 116. Each rocker link 150 also includes an upper portion that extends generally upward from the base member, and the upper distal end of each upper portion may be described as a handle 155 that is sized and configured for grasping. Each rocker link 150 also includes an offset arm 156 that extends generally forward from the base member, proximate the pivot axis. Each rocker link 150 also includes a lower portion that extends generally downward from the base member, and the lower distal end of each lower portion is rotatably connected to the forward end of a respective foot supporting link 130. As suggested in a previous paragraph, and perhaps best seen in FIG. 3, the foot supporting links 130 are positioned "inboard" relative to the handles 155.

Left and right intermediate links 160 have upper ends that are rotatably connected to the distal ends of respective offset arms 156, and lower ends that are rotatably connected to the forward ends of respective crank links 140. On the preferred embodiment 100, the respective intermediate links, crank links 140, and guide rollers 144 are all rotatably connected to one another at a common axis. However, persons skilled in the art will recognize that the present invention is not limited to such an arrangement. In other words, each guide roller 144 could be rotatably mounted to one forward portion of a respective crank link 140, and each intermediate link 160 could be rotatably connected to a discrete forward portion of a respective crank link 140. Alternatively, each guide roller 144 could be rotatably mounted to one lower portion of a respective intermediate link 160, and each crank link 140 could be rotatably connected to a discrete lower portion of a respective intermediate link 160.

Each guide roller 144 is configured and arranged to travel along a respective track or guide 111 that is pivotally mounted on a respective side of the forward stanchion 114, proximate the base 112. The guides 111 are preferably rigidly interconnected to one another by welding each to a common rod 113, and may alternatively be described as at least one guide having first and second tracks. One end of an adjustable length member 190 is rotatably connected to a central section of the rod 113, and an opposite end of the adjustable length member 190 is rotatably connected to the frame 110 (at rod 119). As seen by comparing FIGS. 4 and 5, when the adjustable length member 190 assumes a relatively short configuration (see FIG. 4), the guides 111 are relatively less inclined relative to the underlying floor surface (and the foot supporting links 130 travel a relatively shorter distance measured perpendicular to the crank axis and parallel to the floor surface), and when the adjustable length member 190 assumes a relatively long configuration (see FIG. 5), the guides 111 are relatively more inclined relative to the underlying floor surface (and the foot supporting links 130 travel a relatively greater distance measured perpendicular to the crank axis and parallel to the floor surface).

On the preferred embodiment 100, the adjustable length member 190 is a linear actuator that is preferably linked to the user interface (described above but not shown). Under such circumstances, the adjustable length member 190 changes length in response to a control signal. On an alternative embodiment, a spring and dampener piston is substituted for the linear actuator to accommodate changes in stride length as a function of user imparted force against the handles 155 and/or the foot supporting links 130.

Each foot supporting link 130 has a rearward portion that defines an upwardly facing platform sized and configured to support a person's foot. The left and right foot platforms 133 move through adjacent, generally elliptical paths that are disposed between the left and right crank discs 120. Generally speaking, the vertical displacement of the foot platforms 133 is a function of the crank swing or diameter defined by rotation of the crank members, namely, the radially displaced and diametrically opposed left and right portions of the crank bar 122. On the other hand, the horizontal displacement of the foot platforms 133 is not similarly limited. In this regard, the guides 111 may be adjusted relative to the frame 110, as described above, to provide horizontal displacement ranging from a fraction of the crank diameter to several (at least three) times the crank diameter.

The present invention has been described with reference to specific embodiments with the understanding that persons skilled in the art will recognize various advantages thereof, as well as numerous alternative embodiments thereof. With the foregoing in mind, the scope of the present invention is to be limited only to the extent of the claims which follow.

What is claimed is:

1. An exercise apparatus, comprising:

a frame configured to rest on a floor surface;

a left crank member and a right crank member, wherein each said crank member is rotatably mounted on the frame for rotation about a common crank axis, and the left crank member and the right crank member are diametrically opposed;

a left crank roller and a right crank roller, wherein each said crank roller is rotatably mounted on a respective said crank member;

a left crank link and a right crank link, wherein each said crank link has a rearward portion rotatably connected to a respective said crank member;

at least one guide mounted on a forward portion of the frame, wherein each said crank link has a forward portion movably supported for movement along the at least one guide;

a left rocker link and a right rocker link, wherein each said rocker link has an upper portion rotatably mounted on the frame for pivoting about a common pivot axis, and each said rocker link has an offset arm;

a left intermediate link and a right intermediate link, wherein each said intermediate link is rotatably interconnected between a respective said crank link and a distal portion of a respective said offset arm;

a left foot supporting link and a right foot supporting link, wherein each said foot supporting link has a forward portion rotatably connected to a lower portion of a respective said rocker link, and a rearward portion supported on top of a respective said crank roller, and each said rearward portion defines an upwardly facing platform sized and configured to support a person's foot.

2. The exercise apparatus of claim 1, wherein the at least one guide is pivotally mounted on the frame for pivoting between a first orientation, wherein each said platform travels a first distance measured perpendicular to the crank axis and parallel to the floor surface, and a second orientation, wherein each said platform travels a relatively greater, second distance measured perpendicular to the crank axis and parallel to the floor surface.

3. The exercise apparatus of claim 2, further comprising an adjustable length member movably interconnected between the frame and the at least one guide.

4. The exercise apparatus of claim 3, wherein the adjustable length member is a linear actuator.

5. The exercise apparatus of claim 1, wherein the left crank member is rotatably connected to a left side portion of the frame, and the right crank member is rotatably connected to a right side portion of the frame, and each said platform is disposed to the left of the right side portion and to the right of the left side portion.

6. The exercise apparatus of claim 1, further comprising a left handle and a right handle, wherein each said handle is disposed on an upper distal end of a respective said rocker link.

7. The exercise apparatus of claim 1, wherein a left guide roller is rotatably mounted on the forward portion of the left crank link, and a right guide roller is rotatably mounted on the forward portion of the right crank link, and each said guide roller is configured and arranged to roll along a respective track defined by the at least one guide.

* * * * *